US005783095A

United States Patent [19]

Forsey et al.

[11] Patent Number: 5,783,095

[45] Date of Patent: Jul. 21, 1998

[54] APPARATUS AND METHOD FOR SEPARATION OF CONTAMINANTS FLOATING ON THE SURFACE OF A LIQUID

[76] Inventors: Richard John Forsey, 32 Rydens Road, Walton-on-Thames KT12 3DL; Gareth Ward Pimm, 10 Cherimoya Gardens, West Molesey, Surrey, KT8 9SA, both of United Kingdom

[21] Appl. No.: 750,091

[22] PCT Filed: May 24, 1995

[86] PCT No.: PCT/GB95/01187

§ 371 Date: Nov. 15, 1996

§ 102(e) Date: Nov. 15, 1996

[87] PCT Pub. No.: WO95/32154

PCT Pub. Date: Nov. 30, 1995

[30] Foreign Application Priority Data

May 24, 1994 [GB] United Kingdom ..... 9410335

[51] Int. Cl.[6] ..... E02G 15/04

[52] U.S. Cl. ..... 210/776; 210/242.3; 210/523; 210/923

[58] Field of Search ..... 210/776, 242.3, 210/923, 523

[56] References Cited

U.S. PATENT DOCUMENTS

| | | | |
|---|---|---|---|
| 3,612,277 | 10/1971 | Van Stavern et al. | 210/242.3 |
| 3,726,406 | 4/1973 | Damberger | 210/923 |
| 3,847,815 | 11/1974 | Chastan-Bagnis | 210/242.3 |
| 4,126,552 | 11/1978 | Middelbeek | 21/242.3 |
| 4,305,830 | 12/1981 | Shimura | 210/923 |
| 4,963,272 | 10/1990 | Garrett | 210/242.3 |
| 4,978,448 | 12/1990 | Terokomos | 210/242.3 |
| 5,019,277 | 5/1991 | Andelin | 210/776 |
| 5,108,600 | 4/1992 | Rees et al. | 210/242.3 |
| 5,397,460 | 3/1995 | Koblanski | 210/242.3 |
| 5,445,744 | 8/1995 | Pettersen | 210/776 |

FOREIGN PATENT DOCUMENTS

| | | |
|---|---|---|
| 2 500 431 | 8/1982 | France . |
| 35 15 958 A1 | 11/1985 | Germany . |
| 36 40 847 A1 | 6/1987 | Germany . |
| WO 92/16278 | 10/1992 | WIPO . |

*Primary Examiner*—Christopher Upton
*Attorney, Agent, or Firm*—Flynn, Thiel, Boutell & Tanis, P.C.

[57] ABSTRACT

An apparatus for use in the separation of a floating contaminant from a body of liquid has a rectangular planar sheet with upright wall members on each of two opposed edges and has on one of its other edges an inlet manifold. The inlet manifold has a slot aperture through which is directed a high velocity film of liquid over the sheet. The sheet has at the edge remote from the manifold a collecting device. The sheet is positioned in the liquid so that the film of liquid entrains the floating contaminants and carries them to the collecting device.

18 Claims, 4 Drawing Sheets

APPARATUS AND METHOD FOR SEPARATION OF CONTAMINANTS FLOATING ON THE SURFACE OF A LIQUID

FIELD OF THE INVENTION

This invention relates to apparatus for use in separation of contaminants floating on the surface of a liquid from the liquid and to a separation method using the apparatus.

BACKGROUND OF THE RELATED ART

A number of proposals have been made for separating floating contaminants from the surface of a liquid, for example a body of water, by generating a fluid jet below the surface of the liquid such that on passing through the surface of the liquid, floating contaminant is entrained in an outer layer of the jet and is carried away from the surface, to be collected.

WO92/16278 discloses a method for separating a less dense liquid contaminant from a body of more dense liquid which comprises passing an annular column of liquid at high velocity substantially vertically from within the body of liquid through the surface thereof thereby to entrain the less dense liquid and carry it away from the body of liquid for collection. WO92/16278 also discloses apparatus for performing the method.

This method and apparatus works extremely well but the apparatus is difficult to manufacture and maintain when the apparatus is of large size since maintaining an annular gap of consistent dimension of the order of a few millimeters between concentric tubes of very much larger diameter is extremely difficult to accomplish.

SUMMARY OF THE INVENTION

This invention provides apparatus for use in the separation of a floating contaminant from a body of liquid which comprises a substantially rectangular planar sheet having on each of two opposed edges an upstanding wall member, said sheet having on one of its other edges an inlet manifold for directing a fast flowing film of liquid over substantially the entire area of the sheet, the inlet manifold having at least one pipe connectable to a source of liquid under pressure, and a slot aperture adjacent and substantially parallel with the edge of the sheet to which the inlet manifold is attached, the slot aperture having an area substantially less than the cross-sectional area of the pipe(s) at entry into the inlet manifold, and said sheet further having at the edge remote from the inlet manifold a collecting device for collecting liquid flowing over the sheet whereby, in operation, the sheet can be positioned in a body of liquid at an inclination such that the inlet manifold and its associated edge of the sheet are below the surface of the body of the liquid and the collecting device and its associated edge of the sheet are above the surface of the body of liquid, and liquid under pressure can be passed through the inlet manifold and the slot aperture to emerge as a high velocity film of liquid covering substantially the entire surface of the sheet such that on passing through the surface of the body of liquid floating contaminants are entrained in the film of liquid and carried to the collecting device.

The inlet manifold may comprise a fishtail section which in the direction perpendicular to the plane of the sheet tapers from a dimension equal to the cross-sectional area of the pipe to the slot aperture, and in the direction of the plane of the sheet flares from a dimension equal to the cross-sectional area of the pipe to a dimension substantially equal to the length of the edge at which it is attached to the sheet. The cross-sectional shape of the fishtail section does of course change from the pipe to the slot aperture as described above, but the cross-sectional area of the fishtail reaction remains substantially constant from the pipe to the slot aperture, area change only occurring at the slot aperture.

Alternatively, the inlet manifold may comprise a box section in which the slot aperture is adjacent the top of the box. Preferably the slot aperture comprises two spaced longitudinally aligned slots. The box may be of any convenient shape but is typically of square cross-section for ease of slot formation and attachment to the sheet, and preferably has two pipes, conveniently attached so as to have inlets positioned at either end of the edge of the sheet to which the inlet manifold is attached.

The ratio of slot area to the cross-sectional area of the pipe(s) should be 1:5 or greater, preferably between 1:5 and 1:12, more preferably between 1:10 and 1:12. If the ratio is less than 1:5 the velocity of liquid emerging from the slot may be insufficient to provide effective entrainment of surface contaminants, and if greater than 1:12 the slot may be sufficiently narrow to block passage of liquid from the slot. If more than one inlet pipe is employed the cross-sectional area used to calculate the above ratio is of course the sum of the cross-sectional areas of each pipe.

The collecting device may, for example, comprise a part cylindrical cowl or the like capable of directing the liquid flow from the sheet to a collector arranged, for example, below the sheet.

The apparatus may be mounted on buoyancy means and fixedly positioned in the liquid or it may be mounted on a boat or the like so as to be movable.

BRIEF DESCRIPTION OF THE DRAWINGS

The invention will now be described in detail with reference to the accompanying drawings in which.

DETAILED DESCRIPTION

Figure 1:
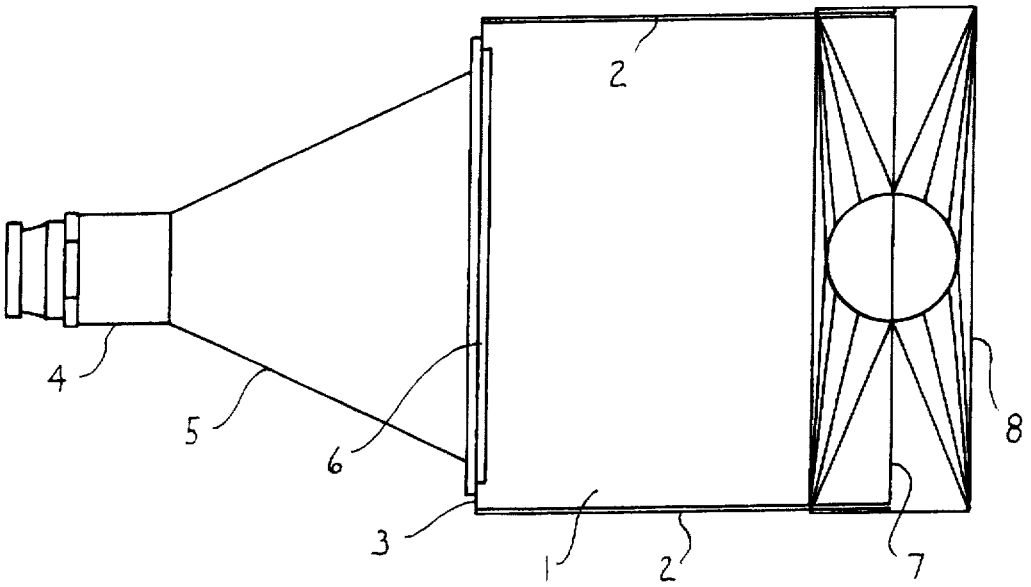
FIG. 1 is a side view of apparatus according to the invention employing a fishtail inlet manifold.
Figure 2:
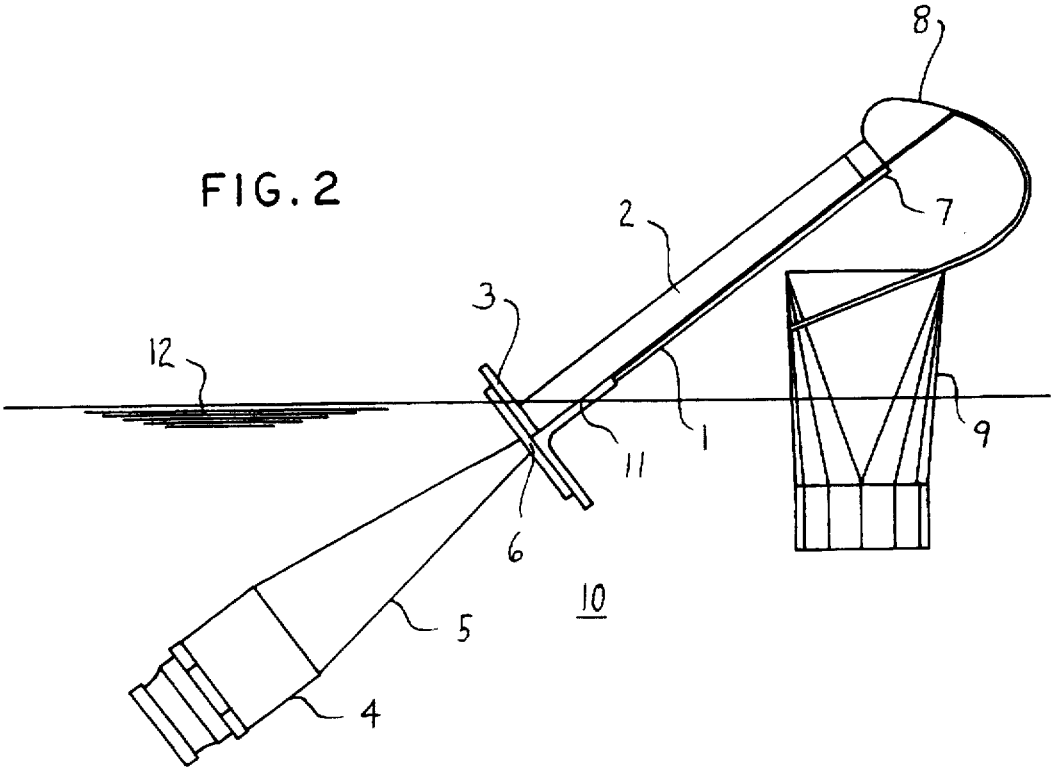
FIG. 2 is a plan view of the apparatus of FIG. 1.

As shown in FIGS. 1 and 2, in a first embodiment the apparatus comprises a substantially rectangular rigid planar sheet (1) having upstanding walls (2) on two opposed edges. Attached to a third edge (3) of the plate (1) is an inlet manifold comprising an inlet pipe (4) for connection by means (not shown) to a source of liquid under pressure and a fishtail section (5). When viewed from a direction perpendicular to the plane of the sheet the fishtail section (5) flares from a dimension equal to the diameter of the inlet pipe (4) to a dimension slightly less than the length of the third edge (3) of the sheet and when viewed from a direction parallel to the plane of the sheet tapers from a dimension equal to the diameter of the inlet pipe (4) to define a slot aperture (6) at the point where it joins the third edge (3) of the sheet. The slot aperture (6) is a constant dimension across the width of the sheet (1) and has an area which is substantially less than the cross-sectional area of inlet pipe (4). At the edge (7) of sheet (1) remote from third edge (3) is a collecting device in the form of a part-cylindrical cowl (8) for diverting liquid flowing off the edge (7) of the sheet (1) into a collector (9). The apparatus is supported by buoyancy means (not shown) such that it can be positioned on a body of liquid and supported thereon with the inlet manifold and third edge (3) of the sheet below the body of liquid and remote edge (7) above the surface of the body of liquid. The angle of inclination of the sheet (1) relative to the plane of the surface of the body of liquid (10) may be adjusted as desired for any given set of circumstances.

In operation of the apparatus, liquid, generally water, is pumped at high pressure through the pipe (4) and issues through the slot aperture (6) as an extremely fast moving film that covers substantially the whole surface of the sheet (1). The integrity of the film of liquid is substantially maintained by surface effects and tends to move in close proximity to the sheet (1).

As the film of liquid passes through the surface of the body of liquid at point (11) it entrains surface contaminant (12) floating on the body of liquid (10) and carries it upwardly away from the body of liquid (10). At the remote edge (7) of the sheet (1) the liquid with entrained contaminant (12) impinges on cowl (8) and is diverted into collector (9) in which the contaminant can be separated by flotation.

Figure 3:
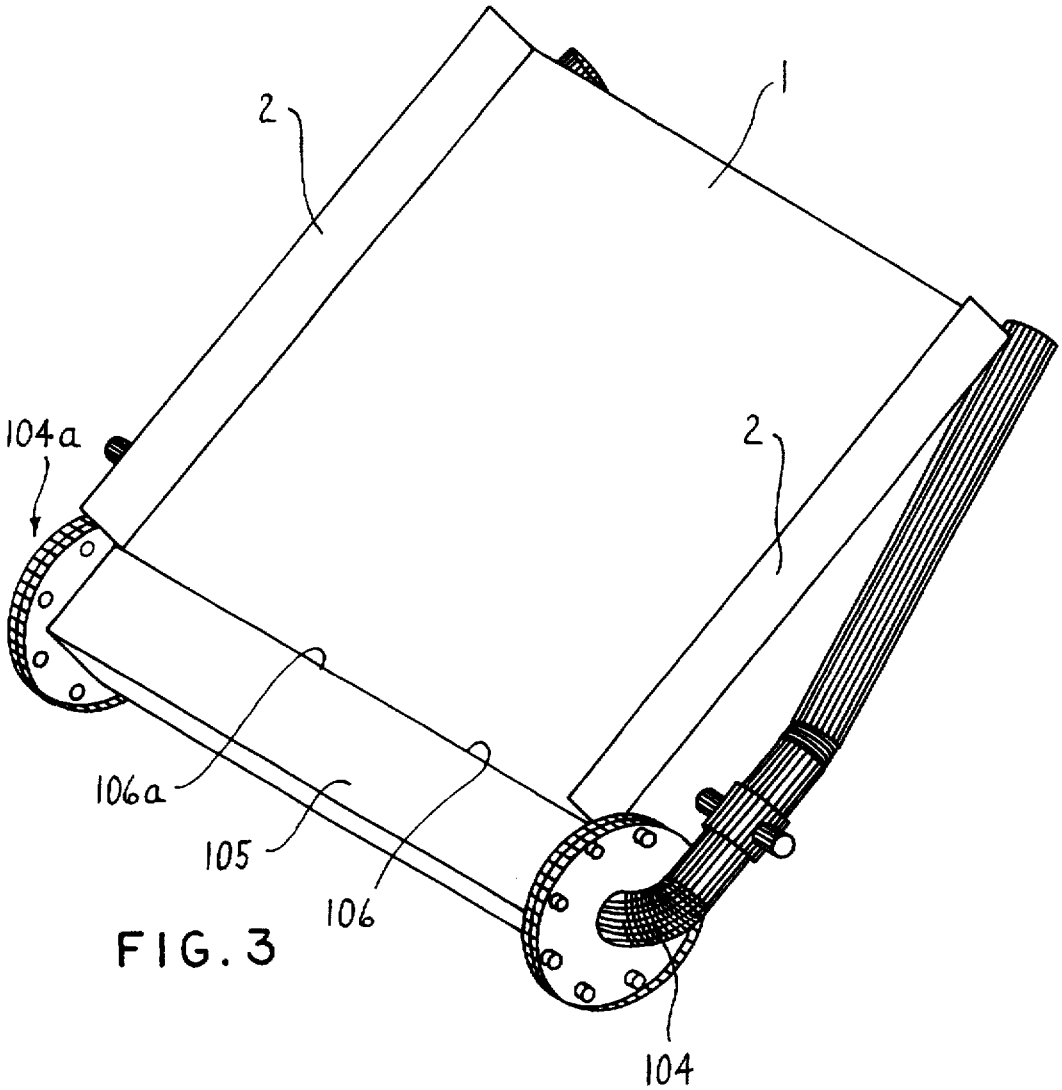
FIG. 3 is a perspective view of a planar sheet and inlet manifold for use in the present invention, wherein the inlet manifold comprises a box section.
Figure 4:
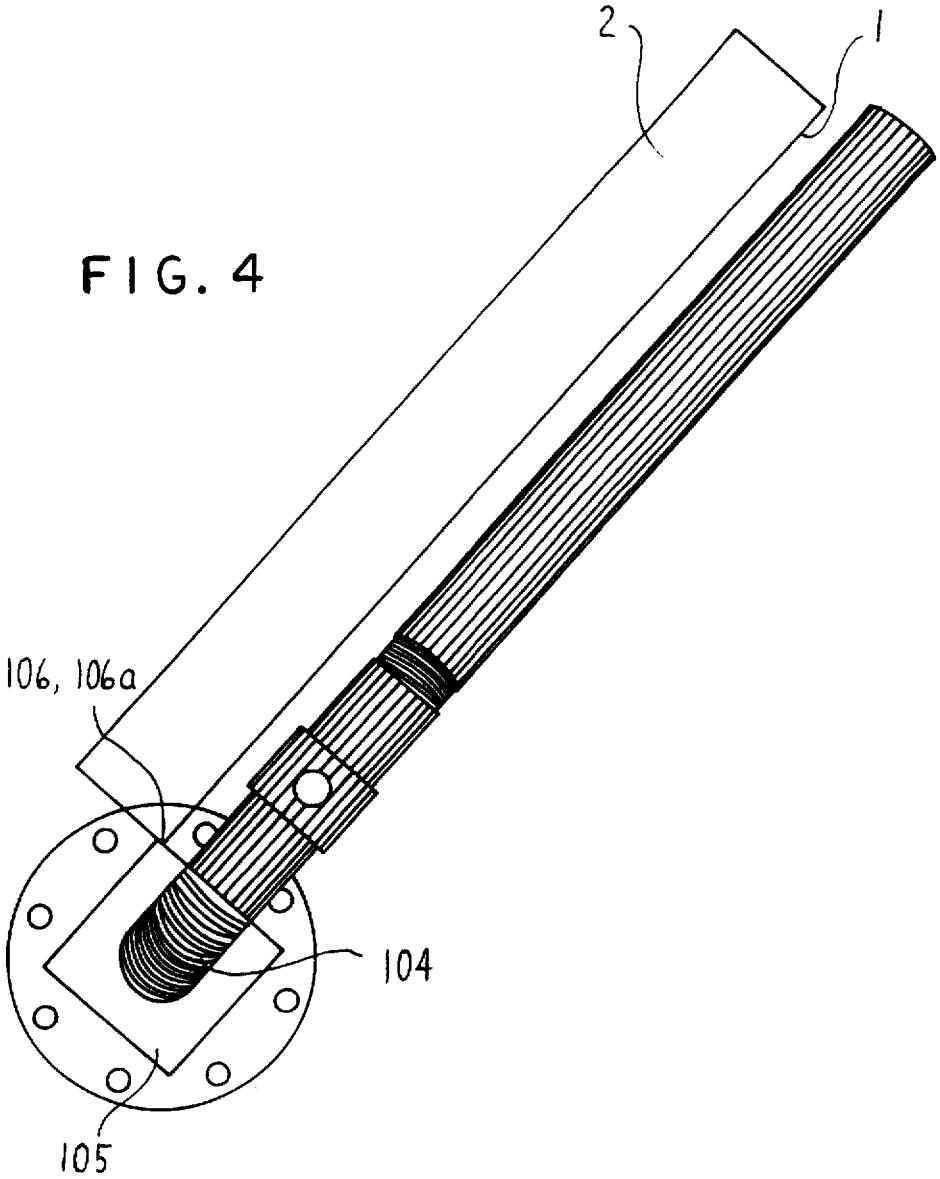
FIG. 4 is a side view of the planar sheet and inlet manifold of FIG. 3.
Figure 5:
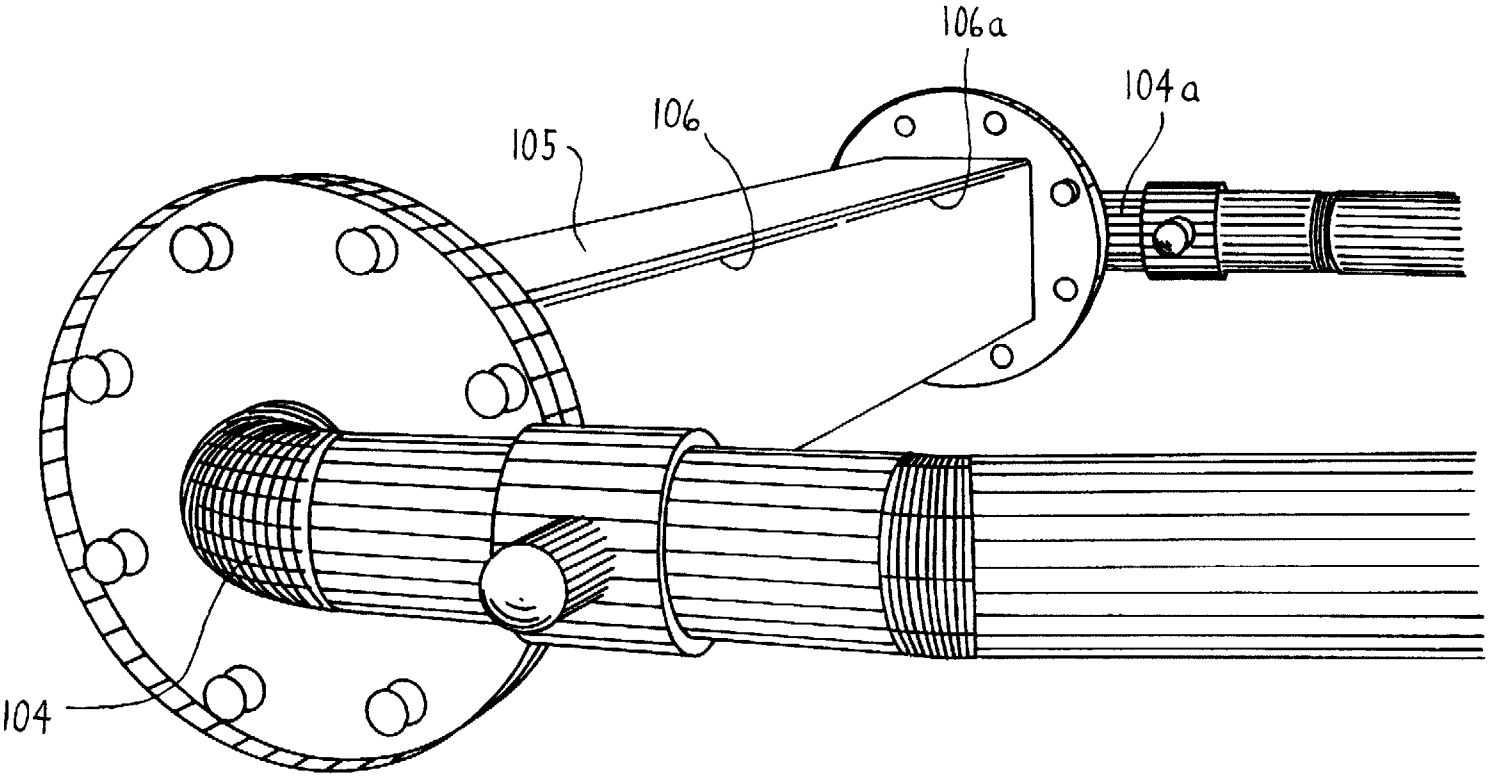
FIG. 5 is an alternative perspective view of the inlet manifold shown in FIGS. 3 and 4.

Referring to FIGS. 3, 4 and 5, in a second embodiment the inlet manifold comprises a box section [105] having two spaced longitudinally aligned slots [106, 106*a*] adjacent the top of the box [105]. The box [105] is of square cross-section and has an inlet pipe [104, 104*a*] at each end thereof. The planar sheet [1] and parts thereof are substantially as described for FIGS. 1 and 2, as is the collecting device (not shown in FIGS. 3, 4 and 5).

Operation of the above-described second embodiment is in principle the same as that described for the first embodiment; liquid is pumped at high pressure through the pipes [104, 104*a*] filling up the box section [105]. When the box section [105] is filled the liquid pressure from the pipes [104, 104*a*] pressurises the liquid in the box section [105] which liquid is consequently expelled through the slots [106, 106*a*] as a fast moving film which covers substantially the whole surface of the sheet [1].

Entrainment of contaminants using the second embodiment is as described above for the first embodiment.

While the dimensions of the device may clearly be varied within wide limits, typical dimensions for a device which is capable of a throughput of 30 tons of liquid per hour through the inlet manifold are:

| | |
|---|---|
| Fishtail | |
| Inlet pipe diameter | 65 mm |
| Slot | 285 mm × 1 mm |
| Planar Sheet | 370 mm × 900 mm |
| Box Section | |
| Inlet pipes diameter | 2 × 63.5 mm |
| Slots | 2 × 450 mm × 1 mm |
| Box cross-section | 150 mm square |

We claim:

1. Apparatus for use in the separation of a floating contaminant from a body of liquid which comprises a substantially rectangular planar sheet having on each of two opposed side edges an upstanding wall member, said sheet being inclined and having on a lower edge thereof an inlet manifold for directing a fast flowing film of liquid upwardly over substantially the entire area of the sheet to an upper edge thereof, the inlet manifold having at least one pipe connectable to a source of liquid under pressure, and a slot aperture adjacent and substantially parallel with the lower edge of the sheet to which the inlet manifold is attached, the slot aperture having an area substantially less than the cross-sectional area of the at least one pipe at entry into the inlet manifold, and said sheet further having at the upper edge remote from the inlet manifold a collecting device for collecting the film of liquid flowing upwardly over the sheet whereby, in operation, the sheet is positioned in a body of liquid at an inclination such that the inlet manifold and the lower edge of the sheet are below the surface of the body of the liquid and the collecting device and the upper edge of the sheet are above the surface of the body of liquid, and the liquid under pressure is passed through the inlet manifold and the slot aperture to emerge as the film of liquid covering substantially the entire surface of the sheet such that on passing through the surface of the body of liquid, the floating contaminants are entrained in the film of liquid and carried to the collecting device.

2. Apparatus according to claim 1 wherein the inlet manifold comprises a fishtail section which in the direction perpendicular to the plane of the sheet tapers from a dimension equal to the cross-sectional area of the pipe to the slot aperture, and in the direction of the plane of the sheet flares from a dimension equal to the cross-sectional of the pipe to a dimension substantially equal to the length of the edge at which it is attached to the sheet.

3. Apparatus according to claim 1 wherein the inlet manifold comprises a box section in which the slot aperture is adjacent the top of the box section.

4. Apparatus according to claim 3 wherein the slot aperture comprises two spaced longitudinally aligned slots.

5. Apparatus according to claim 1 wherein the ratio of the slot aperture area to the cross-sectional area of the pipes is between 1:5 and 1:12.

6. Apparatus according to claim 5 wherein the collector is located below the sheet.

7. Apparatus according to claim 1 wherein the collecting device comprises a part cylindrical cowl capable of directing the liquid flow from the sheet to a collector.

8. Apparatus according to claim 1 which is mounted on buoyancy means.

9. Apparatus according to claim 1 which is mounted on a boat or other propellable floating structure.

10. A method of separating contaminants floating on the surface of a body of liquid from the body of liquid comprising the steps of:

positioning a substantially rectangular planar sheet in a body of liquid at an inclination, one edge of the sheet having an intake manifold with a slot aperture, the sheet having a collecting device at the other edge remote from the intake manifold for collecting contaminants and liquid, the inlet manifold and the one edge of the sheet being below the surface of the body of liquid and the collecting device and the other edge of the sheet being above the surface of the body of liquid; and passing liquid under pressure through the inlet manifold and the slot aperture to emerge as a high velocity film of liquid covering substantially the entire surface of the sheet such that floating contaminants on the body of liquid are entrained in the film of liquid as the film of liquid passes through the surface of the body of liquid and carried upwardly to the collecting device.

11. The method according to claim 10, further comprising the step of diverting the upward moving film of liquid and the floating contaminants entrained therein downwardly from the other edge of the sheet into the collecting device.

12. The method according to claim 11, further comprising the steps of providing a cowl proximate the collecting device and impinging the film of liquid and the floating contaminants entrained therein on the cowl which are diverted downwardly into the collecting device.

13. A separating apparatus for removing contaminants floating on a surface of a body of liquid comprising:

an inclined sheet having a lower edge and an upper edge disposed upwardly relative to said lower edge;

liquid supply means disposed on said lower edge for directing a film of liquid upwardly along said sheet to remove floating contaminants from a body of liquid, said liquid supply means including an inlet manifold which is disposed on said lower edge and includes pressurized liquid therein, said inlet manifold further including an aperture adjacent said lower edge of said sheet, said aperture directing said pressurized liquid out of said inlet manifold as a film of liquid which covers substantially the entire area of said sheet and flows upwardly toward said upper edge, said film of liquid having a high velocity such that when said lower edge of said sheet is disposed below the surface of a body of liquid having floating contaminants thereon, said film of liquid entrains floating contaminants therein and carries said floating contaminants upwardly toward said upper edge; and a collecting device disposed proximate said upper edge for collecting the film of liquid and floating contaminants entrained therein.

14. An apparatus according to claim 13, wherein said sheet includes support means for supporting said sheet in a body of liquid such that said lower edge is disposed below the surface of the body of liquid and the floating contaminants disposed thereon, and said upper edge is disposed above the surface of the body of liquid.

15. An apparatus according to claim 13, wherein said collecting device includes a cowl at said upper edge which diverts the film of liquid downward from said upper edge.

16. An apparatus according to claim 15, wherein said collecting device includes collector means for receiving said film of liquid and the floating contaminants entrained therein.

17. An apparatus according to claim 13, said aperture is a slot which is substantially parallel to said lower edge of said sheet.

18. An apparatus according to claim 17, wherein said sheet includes upstanding side walls on two opposite side edges thereof which direct said film of liquid upwardly along said sheet.

* * * * *